US006199215B1

(12) United States Patent
Biggerstaff

(10) Patent No.: US 6,199,215 B1
(45) Date of Patent: Mar. 13, 2001

(54) FLY CLOSURE FOR GARMENT

(75) Inventor: Sally D. Biggerstaff, Canyon Lake, CA (US)

(73) Assignee: Hurley International LLC, Costa Mesa, CA (US)

( * ) Notice: Subject to any disclaimer, the term of this patent is extended or adjusted under 35 U.S.C. 154(b) by 0 days.

(21) Appl. No.: 09/392,164

(22) Filed: Sep. 8, 1999

(51) Int. Cl.[7] ..... A41D 1/08
(52) U.S. Cl. ..... 2/234; 2/405
(58) Field of Search ..... 2/227, 228, 234, 2/235, 238, 405, 236, 237, 67; D2/731, 732, 733, 734, 735, 738

(56) References Cited

U.S. PATENT DOCUMENTS

| | | | | |
|---|---|---|---|---|
| D. 290,060 | * | 6/1987 | Leo | D2/10 |
| 666,246 | * | 1/1901 | Henderson | 2/237 |
| 1,307,010 | * | 6/1919 | Kinsman | 2/400 |
| 1,832,687 | * | 11/1931 | Boshnack | 2/234 |
| 2,100,933 | * | 11/1937 | Baer | 2/234 |
| 2,444,020 | * | 6/1948 | Markin | 2/235 |
| 3,149,343 | * | 9/1964 | Jacobson | 2/235 |
| 3,599,242 | * | 8/1971 | Kozdal | 2/234 |
| 3,843,973 | * | 10/1974 | Dillenburger | 2/236 |
| 4,006,494 | | 2/1977 | Knoppel . | |
| 4,068,321 | | 1/1978 | Chayer . | |
| 4,069,514 | | 1/1978 | Palmieri et al. . | |
| 4,077,067 | | 3/1978 | Kozdal . | |
| 4,249,267 | * | 2/1981 | Voss | 2/69 |
| 4,259,750 | | 4/1981 | Barna . | |
| 4,364,124 | | 12/1982 | Barna . | |
| 4,389,733 | | 6/1983 | Boykins, Jr. . | |
| 4,429,439 | | 2/1984 | Waugh . | |
| 4,534,087 | | 8/1985 | Lau . | |
| 4,566,158 | | 1/1986 | Lau . | |
| 4,575,873 | | 3/1986 | Smith . | |
| 4,649,574 | | 3/1987 | Michels . | |
| 4,803,740 | | 2/1989 | Dawson . | |
| 5,617,587 | | 4/1997 | Marchbanks . | |
| 5,630,232 | | 5/1997 | Miller et al. . | |
| 5,752,277 | | 5/1998 | van der Sleesen . | |

OTHER PUBLICATIONS

Gershman, Maurice: Journal of the American Medical Asso., vol. 168, No. 7, p. 930, Oct. 1958.*

* cited by examiner

*Primary Examiner*—John J. Calvert
*Assistant Examiner*—Alissa L. Hoey
(74) *Attorney, Agent, or Firm*—Knobbe, Martens, Olson & Bear, LLP

(57) ABSTRACT

A fly closure includes two overlapping flaps which form a shield in a garment, such as shorts or pants. The shield lies flat behind the fly when the fly is closed and provides privacy for the wearer through a mid-section of the fly. When the fly is in an open position, the shield opens to allow the wearer to pull the garment on or off. A flow-through passage at the bottom of the shield enables unrestricted flow of water, sand, etc. through the shield during water play activities of the wearer.

40 Claims, 7 Drawing Sheets

FLY CLOSURE FOR GARMENT

This application claims priority under 35 U.S.C. §119(e) to U.S. application No. 60/099,798, which was filed on Sep. 9, 1998.

FIELD OF THE INVENTION

The present invention relates to garments and, more particularly, to a garment fly that maintains a neat, flat appearance through the fly when closed.

BACKGROUND OF THE INVENTION

It is generally desirable for pants or shorts to lie flat and neatly in the fly area Some fasteners and closure systems are more effective than others in accomplishing a flat, neat look when closing garment flies.

Garment flies are often held closed by a zipper, buttons, or hook and loop fasteners, such as Velcro®. The hook and loop fastener or zipper usually extends the full length of the fly. This construction provides secure closure of the fly for activities such as walking, running, or even swimming; however, such a closure creates other problems. For example, both hook and loop fasteners and zippers require attachment to the fly by way of a seam. This extra seam adds to the bulk of the garment and may cause the fly to bulge. The extra bulk in the fly of the garment tends to look thick and unsightly, lessening the garment's aesthetic appeal.

Zippers and hook and loop fasteners each have a fairly stiff base strip. When the hook and loop fasteners are used in a garment fly, the corners of this strip may tend to extend beyond the area of fly closure and poke at the wearer. Also, over time, these corners may bunch up, thereby causing unsightly bulging.

The closure operation of hook and loop fasteners creates additional problems. For instance, a garment having a fly closure made of hook and loop fasteners will likely be combined with other garments in laundry loads. If the hook and loop fastener has not been completely and fully closed before being thrown in the laundry, it will have a tendency to snag other garments. Such snagging may ruin the other garments.

Similar problems may arise in the use of zippers. For example, as the zipper is being drawn up for closure, it can snag or pinch the wearer's underclothing, thereby causing damage. Also, the added bulk of the zipper itself and the stitching to hold it in place increase bulging in the fly area.

A number of other types of fasteners may be used to close garment flies. These may include buttons, snaps, clips, or lace ties that extend the entire length of the fly. Buttons, snaps, and clips, however, have a tendency to create bulges or tugs that may be unsightly, especially because they extend the entire length of the fly. A similar aesthetic problem arises when lace ties extend the entire length of the fly.

The fly may be closed by locating buttons, snaps, clips, or ties only in the upper waistband of the fly. However, such a method of closure does not seal the middle section of the fly. This presents a pivacy problem, as the fly will tend to open with motion of the wearer.

A more particular set of problems is found in the area of garment flies used in swimsuits and board shorts. It is common for men and women to wear board shorts when engaging in surfing, swimming, or similar activities. Women tend to prefer to wear such board shorts pulled over a more conventional women's swimsuit when engaging in such activities. Wearing the more durable board short gives the wearer a more secure feeling as well as a preferred aesthetic look for the activity.

The fly of such board shorts is usually closed along its full length by strips of hook and loop fasteners or a zipper. This construction provides a secure closure of the fly for activities such as surfing and swing. However, such a closure creates the snagging problems discussed above. For example, to pull the shorts on, the hook and loop fastener strips must first be disconnected from each other in an "open" fashion. When the board shorts are pulled over a woman's swimsuit, the open hook and loop fastener strips have a tendency to catch and stick to the swimsuit material. This snagging of the woman's swimsuit can create runs in the swimsuit or break the stitching, thus ruining the swimsuit and causing the owner/wearer considerable expense. Similar problems may arise with the use of zippers because of their pinching tendency. Also, the tendency of hook and loop fasteners or zippers to make the fly look thick and unsightly is especially undesirable in swimwear.

Other types of fasteners, such as buttons, snaps, clips, or lace ties, may be used to close the fly of such a swimming short. The problem with these methods are that the buttons, snaps, and clips have a tendency to be uncomfortable for a person laying on a hard surfboard because of the hard bulges that they cause. This drawback is exacerbated when such fasteners extend the entire length of the fly. Also, the unsightly effect of these bulges is considerable. As already discussed, an aesthetic problem arises when ties extend the entire length of the fly.

SUMMARY OF THE INVENTION

The present invention recognizes and addresses the need for an improved fly closure system which is comfortable to the wearer, avoids the snagging problems of hook and loop fasteners and zippers, and prevents unsightly bulges while still protecting the wearer's privacy in the fly area.

The present invention addresses the need in the art by achieving closure of the fly and avoiding the use of hook and loop fasteners or zippers. Aesthetically pleasing closures, such as lace ties or hook fasteners are located in the waistband and pull the fly together. A shield in the fly area provides privacy to the wearer. This shield opens wide enough to allow the wearer to pull on the garment. When the ties pull the garment closed, the shield folds over itself and lies flat on the inside of the fly. The shield also allows water and sand to flow through and not collect in the bottom of the shield, as accumulation of water or sand would cause the shield to balloon and sag, thus causing discomfort to the wearer.

The present fly closure system uses laces or another aesthetically pleasing closure device at the top of the garment's fly in the waistline area. Right and left front panels are positioned below the waistline and on opposite sides of the fly. The right and left front panels are sewn together below the fly. A shield is positioned behind the panels in the fly. The shield includes a back flap and a front flap. The back flap extends from the right front panel and the front flap extends from the left front panel. The back and front flaps are attached to each other along a seam. When the fly is open, and the left and right front panels are pulled away from each other, the shield is also pulled open. When the fly is closed, the flaps of the shield overlap each other and lie flat behind the front panels. In this position, as the wearer moves about while walking, running, surfing, swimming, or doing other activities, the shield provides closure and privacy in the wearer's fly area.

The bottom of the shield is not sewn closed. This open bottom comprises a flow-through and provides a number of advantages, especially for swimsuits such as board shorts. Water and sand flow through the open-bottomed flow-through and do not accumulate in the shield. Accumulation of water and sand in the shield could cause discomfort to the wearer and also could cause drag on the shield itself by the shield expanding like a balloon when it accumulates water. Such drag could cause the shield to bunch up, causing discomfort to the wearer and creating unsightly bulges. By allowing the water and sand, etc. to flow uninhibited through the bottom of the shield, the flow-through provides the advantage of extra comfort to the wearer and enables the shield to lie flat.

The points at which the back flap and front flap of the shield each connect to the main seam of the fly are slightly offset from each other. This offset positioning is advantageous because the two flaps do not meet the main fly seam at the same point. Thus, a bulky seam which would be created by the two flaps meeting directly on top of each other is avoided. As discussed above, elimination of bulges provides increased comfort to the wearer and an aesthetically pleasing look. Elimination of bulges is especially important when surfing because the user is often laying on a hard fiberglass surfboard and every bulge tends to push into the wearer's body and cause discomfort.

In accordance with one aspect of the present invention, a garment is provided having first and second panels. A shield is coupled to a portion of the first panel and a portion of the second panel. The shield comprises a first flap extending from the first panel and a second flap extending from the second panel. The first and second flaps are joined to each other along a fold line and are adapted to overlap each other when the shield is in the closed position.

In accordance with another aspect, the present invention includes a garment closure system comprising first and second panels of a garment, and a fly defined between the panels. The fly has a base point and is adapted to open and close. Shielding means are positioned in the fly for preventing visual access through the fly. The shielding means includes means for facilitating water flow therethrough. Means are also provided for releasably securing the waistband in a closed position.

In accordance with yet another aspects the present invention includes a garment comprising a first panel having a first edge and a second panel having a second edge. The first and second edges are adapted to overlap each other and are joined to each other along a panel seam. A panel fly is defined between the first and second edges, which are movable into and out of engagement with each other in the panel fly. A base point is provided at a junction of the panel seam and the panel fly. A first flap is joined to the first panel and a second flap is joined to the outer panel. A flap seam connects the first and second flaps.

For purposes of summarizing the invention and the advantages achieved over the prior art, certain aspects and advantages of the invention have been described herein above. Of course, it is to be understood that not necessarily all such aspects or advantages may be found in accordance with any particular embodiment of the invention. Thus, for example, those skilled in the art will recognize that the invention may be embodied or carned out in a manner that achieves or optimizes one advantage or group of advantages as taught herein without necessarily achieving other aspects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

The figures describe preferred embodiments of the present invention as incorporated in a pair of board shorts. It is to be understood that the fly closure of the present invention may be used in other garments.

DETAILED DESCRIPTION OF THE PREFERRED EMBODIMENT

The following detailed description describes the use of the fly closure system or device of the present invention on a pair of women's board shorts. It should be understood that the present invention may be used in other garment applications, including, but not limited to, men's and women's pants and shorts for use in or out of water. For instance, this fly closure system could also be effectively used in skirts, dresses or blouses.

Figure 1:
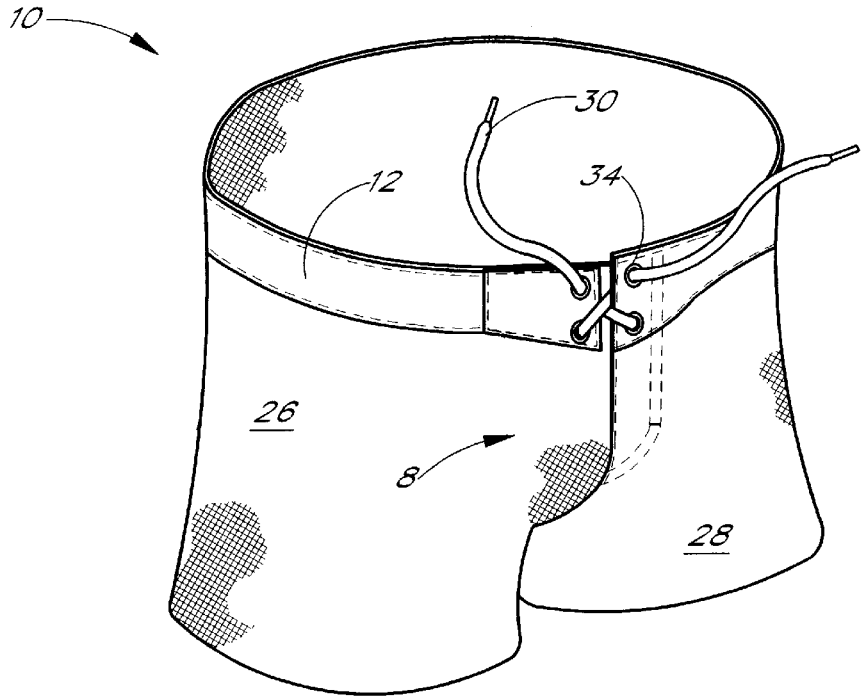
FIG. 1 is a perspective view of a pair of board shorts with the fly closure device of the present invention. Laces are used to close the top of the fly and the fly is shown in a closed position.

With reference to FIG. 1, a perspective view of a pair of women's board shorts 10 is shown. The shorts 10 include a waistband 12, a right front panel 26 and a left front panel 28. Laces 30 extending through grommets 34 at the waistband 12 close the fly 8, which lies flat when closed. These board shorts are preferably constructed of a quick-dry type fabric, such as nylon, sanded excaliber nylon, or dynasuede polyester.

Figure 2:
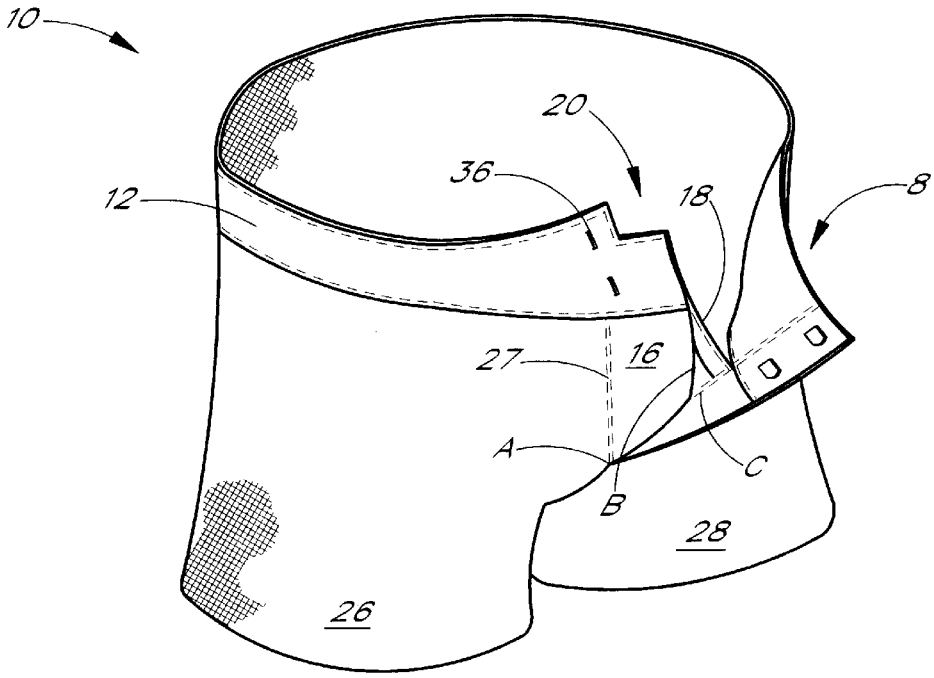
FIG. 2 is a perspective view of a pair of board shorts with the fly closure device of the present invention shown with the fly open and the shield visible. Clip fasteners are shown to close the top of the fly.

FIG. 2 also provides a perspective view of the board shorts 10, showing another embodiment in which hook fasteners 36 are used to close the fly 8 in the waistband 12 area. It is to be understood that various closure apparatus can be used to close the fly at the waistband.

Figure 3:
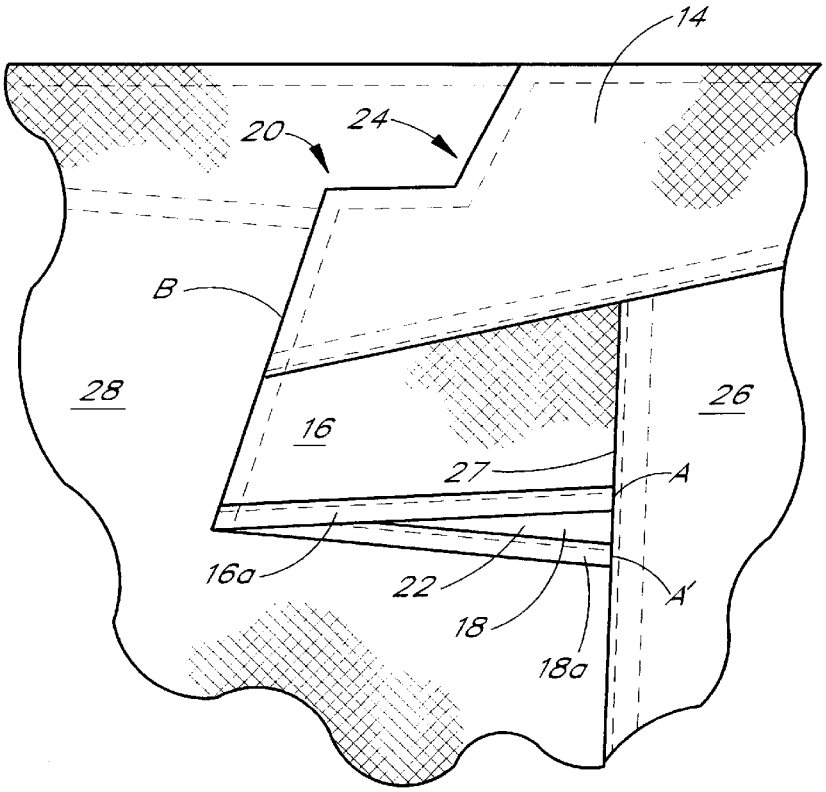
FIG. 3 is a view of the fly area of the board shorts of FIG. 1 from inside the shorts and showing the shield lying flat and in a closed position.

In FIG. 2, the board shorts 10 are shown with the fly 8 pulled open. A shield 20 is provided in the fly 8 and conununicates with both the right and left panels 26, 28. The fly 8 extends from the waistband to a base point A at which the right and left front panels 26, 28 are sewn together. The base point A is preferably positioned along a central seam 27. With reference also to FIG. 3, the front panels remain sewn together along the central seam 27 below the base point A. In the illustrated embodiment, the left panel 28 overlaps the right panel 26 at the seam 27.

Figure 4:
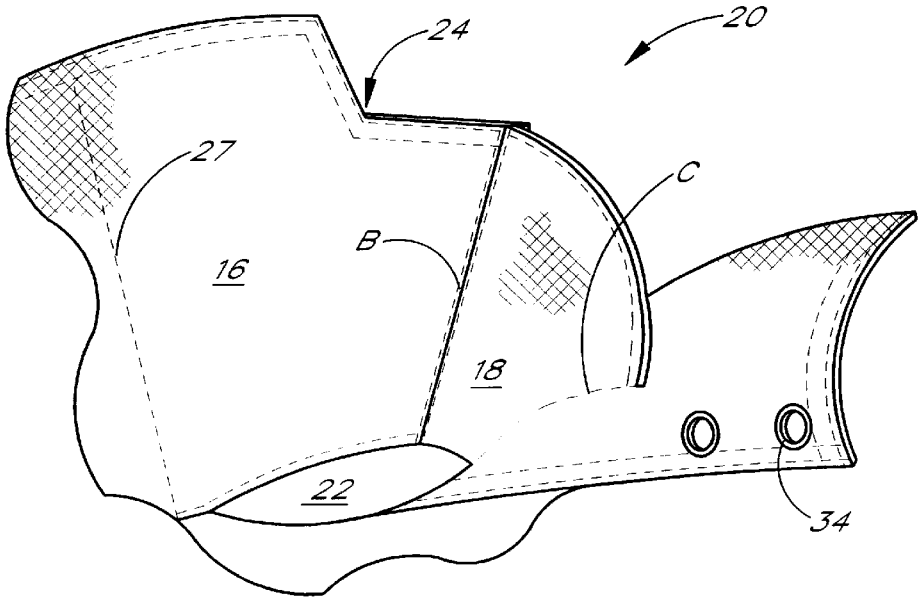
FIG. 4 is a close-up perspective view of the shield and fly area of the board shorts of FIG. 1, showing the fly pulled open and the shield in an open position.

FIG. 4 shows the fly 8 pulled wide open, exposing a shield 20. As shown in FIGS. 2 and 4, the right front panel 26 extends toward the fly 8 to the center seam 27. At this seam 27, the right front panel 26 connects to a back flap 16. The back flap 16 extends beyond the right front panel 26 and terminates at seam B, where it is connected to a front flap 18. The front flap 18 connects to the left front panel 28 at a seam C. The back flap 16 and front flap 18 together make up the shield 20.

Though the back flap 16 and the right front panel 26 are composed of separate pieces of material in the illustrated embodiment, these components may be formed of a single piece of material. Those skilled in the art will also appreciate that a single piece of fabric could be used for the back 16 and front 18 flaps, without using seam B. In the illustrated embodiment, seam B provides a natural folding effect between the front and back flaps 16, 18. This natural folding effect facilitates overlap of the flaps and reduces bunching-up of the shield 20 when the fly 8 is closed.

Referring back to FIG. 2, the shield 20 unfolds and opens so that the wearer can pull the shorts 10 on over her hips. Once on the wearer, the fly 8 may be closed as shown in FIG. 1. Because the back flap 16 and front flap 18 overlap and extend opposite to each other, they lie flat when the fly 8 is closed, as shown in FIG. 3. Also, any movement of the wearer that would tend to open the middle portion of the fly 8, between the waistband 12 and the base point A, would expose only the flaps 16, 18 of the shield 20. Thus, visual access through the fly is prevented and the wearer's privacy is preserved.

FIG. 3 provides a close up view of the back portion of the fly 8, viewed from within the shorts 10. The shield 20 is shown lying flat in the closed position with the back flap 16 and front flap 18 overlapping over each other. In the illustrated embodiment, a notch 24 is formed in the waistband 12, bringing the waistband 12 into conformance with the back flap 16. A waist panel 14 extends into the back flap 16 to the seam B. While this arrangement is shown in the illustrated embodiment, it is not required. For instance, in other embodiments, the waist panel 14 can just as easily extend only to the notch 24. Also, the notch 24 can be removed or replaced with any desired shape.

The back and front flaps 16, 18 each have bottom edges 16*a*, 18*a*. In the illustrated embodiment, the fabric is folded and sewn at the bottom edges to provide structural integrity. Because of the folding, the bottom edges are bulkier than the rest of the flaps. To avoid a bulky look and feel, the bottom edges 16*a*, 18*a* are attached to the main seam 27 at different points. The bottom edge 16*a* of the back panel 16 is sewn to the main fly seam 27 at the base point A. The front flap 18 meets the center seam 27 at the base point A', which is slightly offset from and below point A along the seam 27. As such, instead of a bulky stitch point that would result from both flaps meeting the seam 27 at the same point, two less bulky and less noticeable stitch points secure the flap bottom edges 16*a*, 18*a* to the seam 27. Also, because of the offset positioning of the stitch points A, A', the bottom edges 16*a*, 16*b* do not overlap each other over the majority of their lengths and are not aligned with one another.

Figure 5:
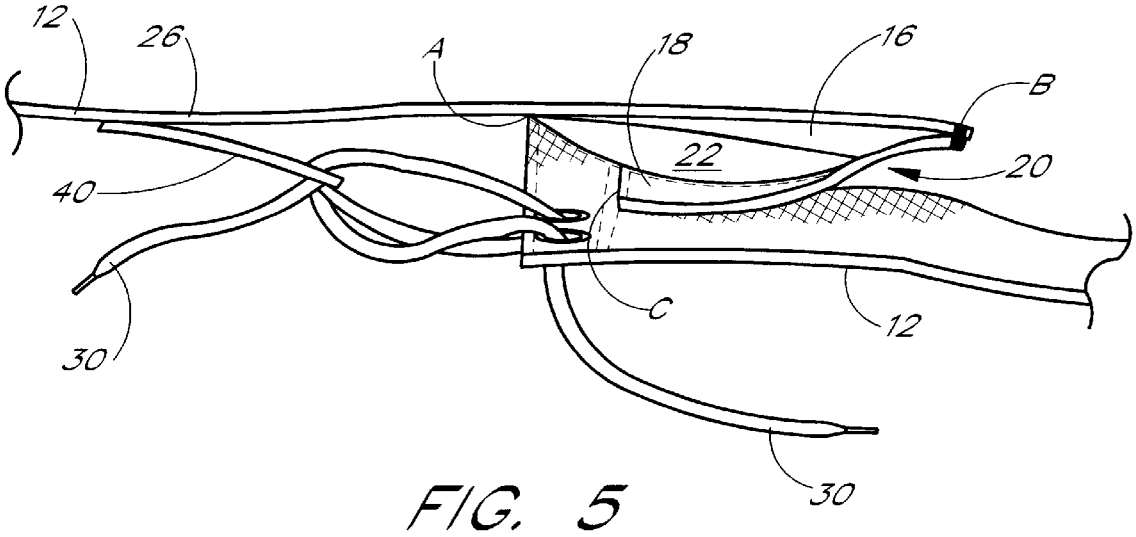
FIG. 5 is a top view of the fly area ofthe board shorts of FIG. 1.

With reference to FIGS. 3–5, the bottom edges 16*a*, 16*b* of the back flap 16 and front flap 18 are preferably not sewn together, except along seam B. This arrangement provides a flow-through passage or opening 22 at the bottom of the shield 20. This flow-through opening 22 between the flaps 16, 18 enables water, sand, etc. to flow unrestricted through the overlapping flaps. Thus, water, sand, etc. will not collect between the flaps as it would in a sewn-closed pocket. Typical closed-bottom pockets, such as those in swimsuits, have a tendency to collect water and air thereby creating a "balloon" within the swimsuit. Such ballooning tends to create drag when the wearer is swimming. Also, sand and other debris in water tends to collect in such pockets during swimming activity. By allowing water to proceed through a direct and unrestricted passage between the flaps 16, 18 of the shield 20, the flow-through 22 prevents the ballooning and sand-retention that comes with water collection, and comfort of the wearer is increased. Also, the shield 20 is more likely to retain its substantially flat shape and to not sag.

FIG. 5 is a top, partially open view of the fly 8, including the shield 20, which shows the overlapping orientation of the front flap 18 and back flap 16. Formed in the shield 20 between the back flap 16 and front flap 18, the flow-through 22 enables unrestricted flow of water, sand, etc. through the shield 20 when the shorts 10 are being worn. Water moving across a swimming wearer's body proceeds across and directly through the flow-through 22. The flow-through 22 thus enables water to flow through the shorts without accumulating in the shield 20.

The overlapping flaps 16, 18 of the shield 20 unfold when the fly 8 is opened to allow the fly to open wide. The ability of the fly 8 to be opened wide helps the shorts 10 to attain a close fit by allowing the shorts 10 to slip over the wearer's hips without having to make the waistline 12 or fly 8 larger. By avoiding such an enlarged waistline 12 or fly 8, the shorts 10 attain a closer, more comfortable fit on the wearer when the fly 8 is closed. Also, by avoiding an overly long fly 8, this arrangement aids the shield 20 in lying flat. This is a useful aesthetic consideration because a shorter fly 8 has less of a tendency to "pooch up" when the wearer is sitting and is more likely to lay flat.

In the illustrated embodiment, the waist band includes a securement flap 40 which includes grommets 34 that engage the laces 30 for closure of the fly 8 at the waistband 12. The securement flap 40 is attached to the waistband 12 along one side 41. In this arrangement, tension that may result from closure of the fly is communicated through the securement flap 40, minimizng interference with the back flap 16 when the laces are tightened.

Figure 6:
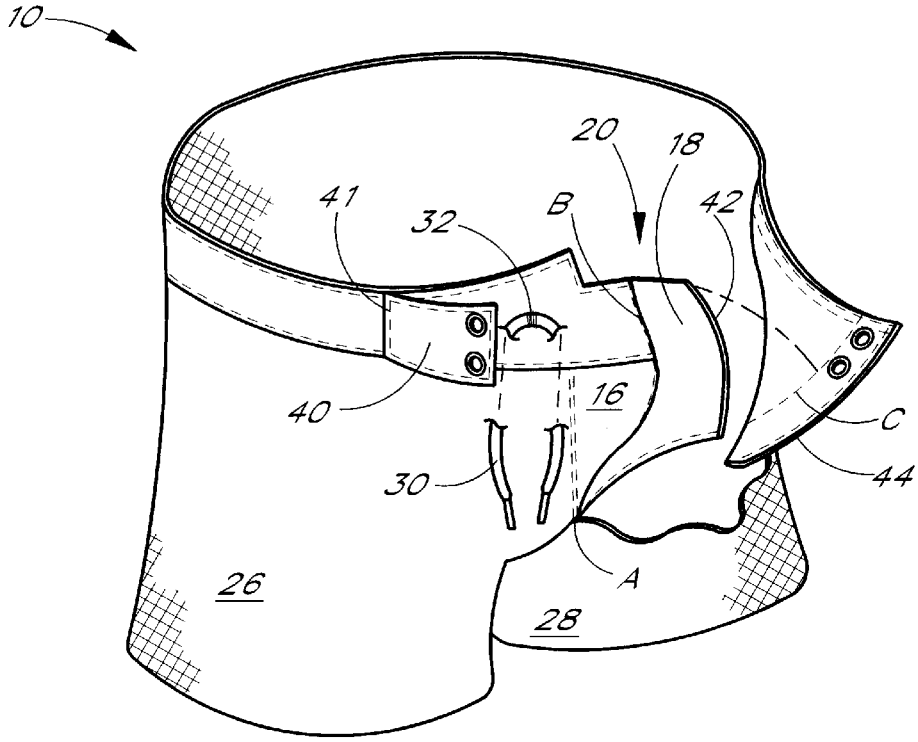
FIG. 6 is a perspective view of the board shorts of FIG. 1 in which the front panel of the shorts has been partially cut away and detached from the shield in order to show the construction and manner of attachment of the shield.

FIG. 6 is a perspective view in which the shorts 10 have been partially cut away, disassembled, and pulled apart in the fly area. This cut away and partially detached view shows that the edge 42 of the front flap 18 of the shield 20 meets and is sewn onto the left front panel 28 at seam C. It is to be understood that variations of the attachment of the front flap 18 to the front panel 28 can be made. For instance, the edge 42 of the front flap 18 can extend and be attached to the edge 44 of the left front panel 28. In such a case, seam C would provide additional securement of the front flap 18 to the left panel 28.

FIG. 6 further illustrates that a lace anchor seam 32 can be used to sew the laces 30 onto the waistband 12. The laces 30 are thus permanently connected to the shorts and there is no danger of the laces 30 becoming lost if removed from the grommets 34.

Figure 7:
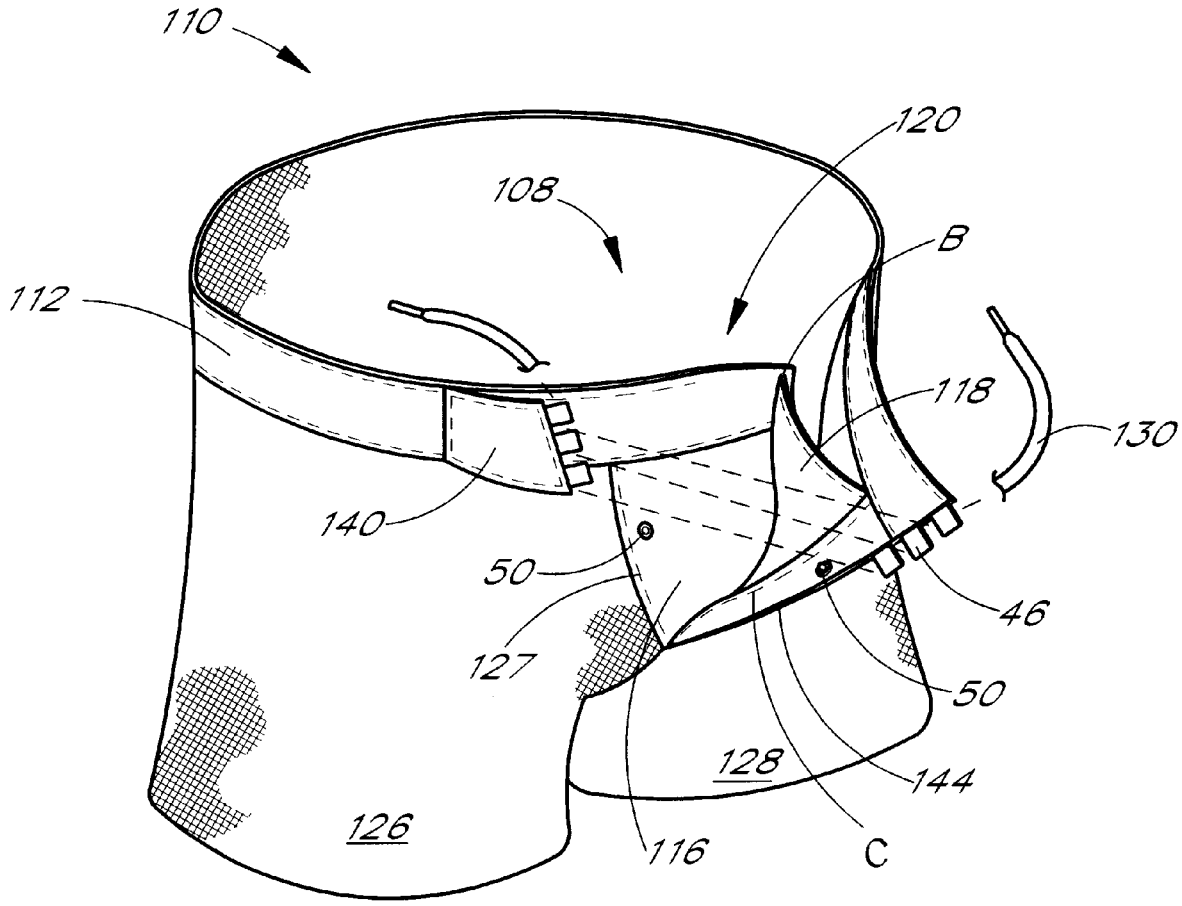
FIG. 7 is a perspective view of a pair of board shorts employing another embodiment of the fly closure device of the present invention, shown with the fly pulled open.

With next reference to FIG. 7, a pair of shorts 110 is shown employing another embodiment of the fly closure device of the present invention. The illustrated embodiment includes some structure similar to the embodiments discussed above. For example, a shield 120 is provided and includes a back flap 116 and a front flap 118 joined to each other along a seam B. Other similar structural members are denoted by numbers that correspond to the numbering above. For instance, the shorts 110 include a waistband 112 having a securement flap 140 and the shield 120 communicates with right and left front panels 126, 128 of the shorts 110.

Figure 8A:
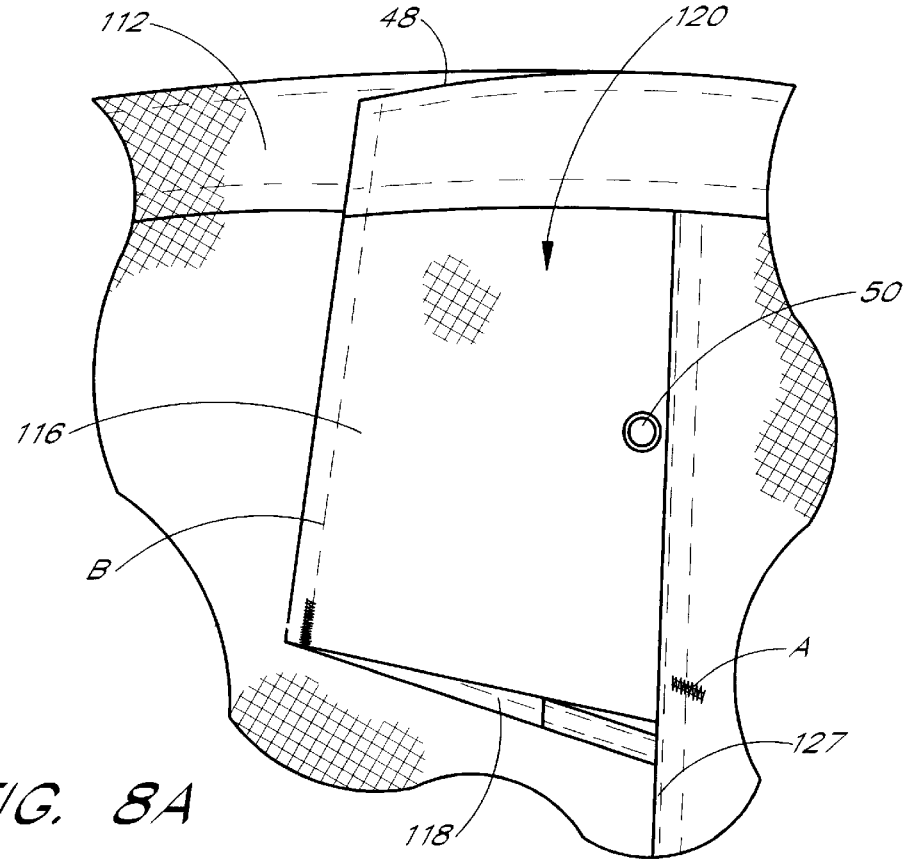
FIG. 8A is a close-up view of the back side of the fly portion of the board shorts of FIG. 7, shown with the fly closed.
Figure 8B:
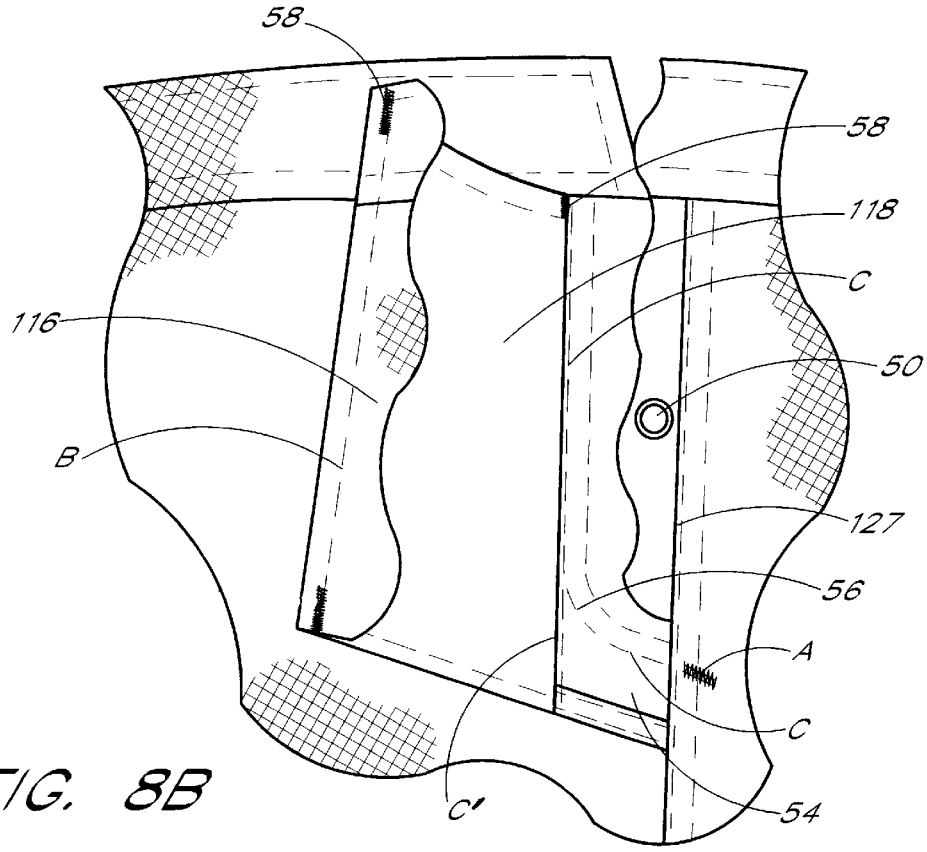
FIG. 8B shows the closed fly portion of the board shorts of FIG. 8A with the back flap cut away.

In the fly closure device illustrated in FIGS. 7, 8A and 8B, laces 130 are threaded through loops 46 formed on the waistband 112 to facilitate closure of the waistband 112. Additionally, the waistband 112 has a curving portion 48 rather than a notch 24 for bringing the waistband into correspondence with the back flap 116.

In the illustrated embodiment, a snap 50 is provided in the fly between the base point A and the waistband 112. The snap 50 is located immediately adjacent the center seam 127 and operates to releasably secure the back flap 16 and front flap 18 together when the fly is closed. While the snap is not required to close the fly, this closure gives additional protection to ensure the wearer's privacy and discourage the fly from "pooching up."

The shield 120 is adapted to lay flat when the fly 108 is closed. FIG. 8B shows the shield 120 with the back flap 116 cut away. A portion 54 of the left front panel 128 is folded at the left front panel edge 144 (FIG. 7) and extends back to seam C. This folded flap 54 connects to the front flap 118 at seam C. However, seam C has a bend point 56 at which the seam turns toward the center seam 127. The front flap 118 and folded flap 54 both extend beyond the bend point 56. A continuing seam C' extends from seam C at the bend point 56 and joins the front flap 118 to the folded flap 54. In the illustrated embodiment, the front flap 118 and back flap 116 are connected to each other along seam B.

When the shield 120 is pulled open, stresses may be exerted along the seams B, C which secure the shield 120 into place. Stress points 58 near the top of the seams can be expected to experience stress concentrations when the fly 108 is pulled open. To provide additional structural integrity, additional stitching is provided at the stress points 58.

Figure 9:
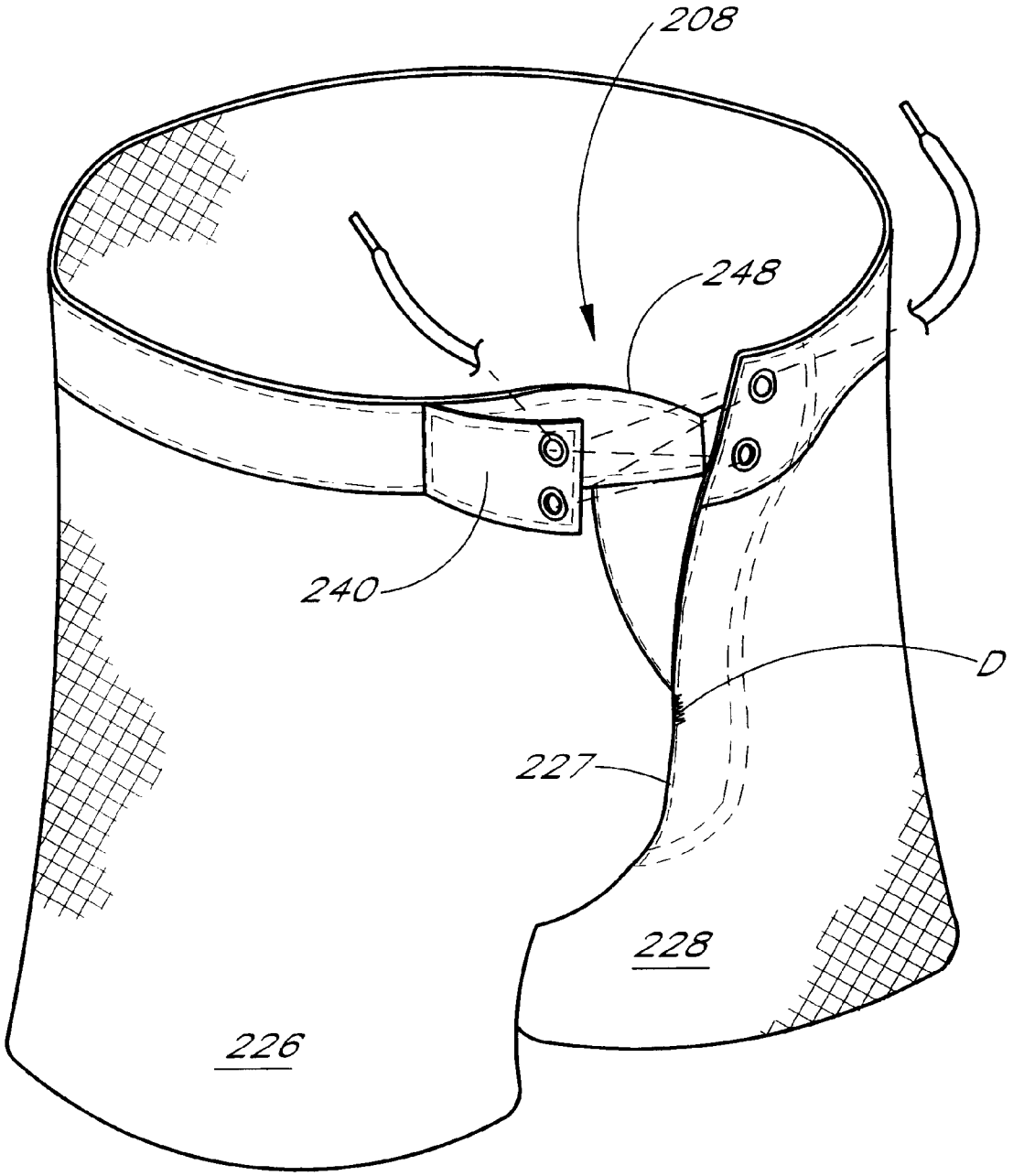
FIG. 9 is a perspective view of a pair of board shorts employing another embodiment of the fly closure device of the present invention, shown with the fly pulled partially open.
Figure 10:
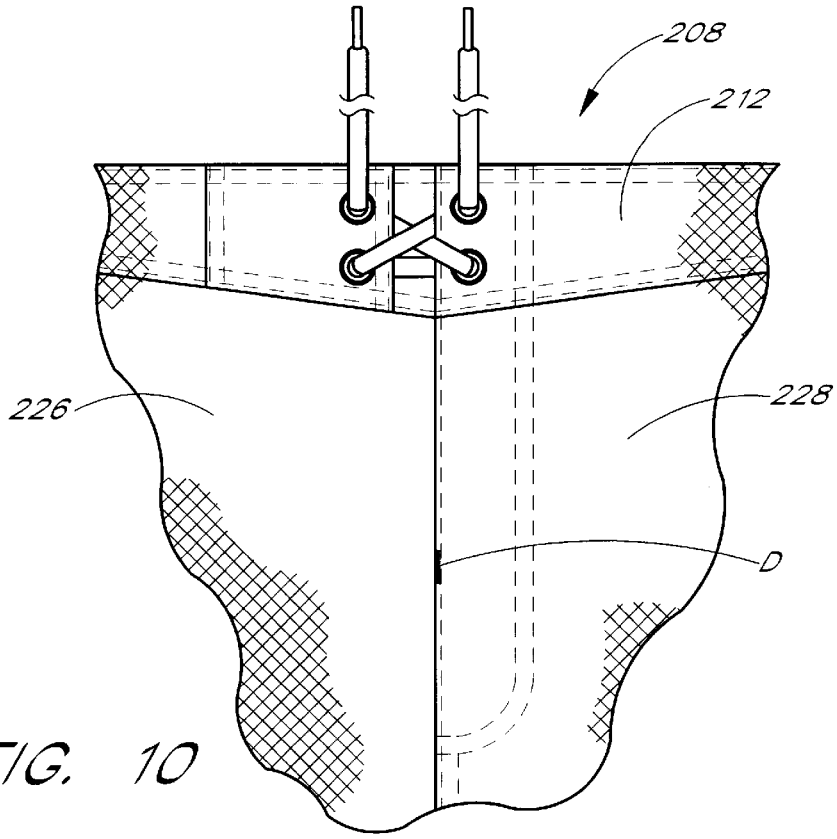
FIG. 10 is a close-up front view of the front side of the fly portion of the board shorts of FIG. 9, shown with the fly closed.
Figure 11:
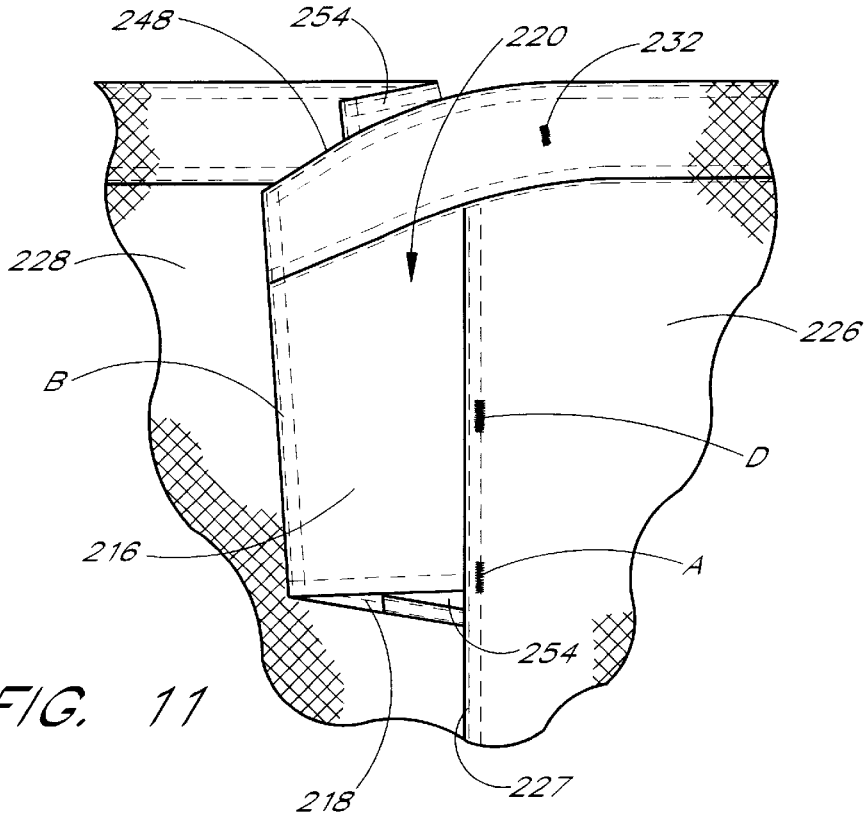
FIG. 11 is a close-up view of the back side of the fly portion of the board shorts of FIG. 9, shown with the fly closed.

A fly closure employing a shield having a flow-through passage may also be used for men's board shorts. FIGS. 9–11 show an embodiment of the fly closure device of the present invention adapted for use in men's board shorts.

With reference to FIGS. 9–11, construction of the men's gannent fly closure system is preferably similar to that shown and described above with reference to FIGS. 7 and 8A–B. For instance, a right front panel 226 and a left front panel 228 are joined together along a center seam 227. A fly 208 is also defined between the panels. A shield 220 is positioned within the fly and comprises a back flap 216 and a front flap 218 which overlap when the fly 208 is in a closed position. The back flap 216 extends from the right front panel 226 to a seam B, along which it is joined to the front flap 218. The front flap 218 extends and is stitched to a folded-over portion 254 of the left front panel 228. The waistband 212 has a lace anchor seam 232 to retain the laces, a securement flap 240 to aid closure of the fly 208, and a curving portion 248 adjacent the back flap 216.

In men's shorts, the length of the fly 208 between the waistband 212 and the base point A is relatively longer than in a corresponding women's garment. The longer fly length is used because men's bodies are typically longer through this area than women's bodies. Also, because men tend to have narrower hips than women, when being pulled over the wearer's hips, the fly of a man's garment typically does not need to be opened as wide as the fly of a women's garment having the same waist size. Thus, the flaps of the shield portion 220 in the illustrated embodiment have somewhat less width between the center seam 227 and the seam B than in the corresponding women's embodiment.

As discussed above, the shorter the fly, the less the fly has a tendency to "pooch up." To shorten the worlking length of the fly 208 in the men's embodiment, a shortened or secondary base point D is employed along the seam 227 and above the standard base point A. The fly is sewn closed and will not open along seam 227 below the shortened base point D. Thus, although the fly appears to extend the full length of the front portion of the garment, the working length of the fly extends only between the waistband and the shortened base point D.

The fly closure system of the present invention may be used in applications other than men's and women's board shorts 10. Also, the flat lay of the shield 20 behind the fly 8 portrays a pleasing aesthetic look that will be suitable for more traditional men's or women's clothes for use in or out of water.

Although this invention and its preferred embodiments have been described in connection with the particular figures, it is not intended that this description should in any way be limited by those figures. Other embodiments consistent with the principles disclosed herein may also be useful.

What is claimed is:

1. A garment comprising:

a first panel;

a second panel;

the first and second panels being joined together along a portion of their lengths by a seam;

a shield coupled to a portion of the first panel and a portion of the second panel, the shield comprising a first flap extending from the first panel and having an upper, lower and distal edge, and a second flap extending from the second panel in substantially the same direction as the first flap and having an upper, lower and distal edge, the first and second flaps connected along their respective distal edges, at least a portion of the first flap overlapping at least a portion of the second flap when the shield is in a closed position; and a passage defined between the lower edge of the first flap and the lower edge of the second flap.

2. A garment as in claim 1, wherein the first and second flaps are connected along their distal edges by stitching.

3. A garment as in claim 1, wherein the lower edge of the first flap and the lower edge of the second flap generally do not overlap each other when the shield is in the closed position.

4. A garment as in claim 1 additionally comprising a waistband extending from the first and second panels, the waistband including a fastener adapted to releasably hold the first and second panels in close proximity to one another.

5. A garment as in claim 4, wherein the fastener comprises laces threaded through grommets in the waistband.

6. A garment as in claim 4, wherein the first and second panels are joined at a base point and a fly is defined between the base point and the waistband.

7. A garment as in claim 6 additionally comprising a non-snagging second fastener located between the waistband and the base point, the fastener being adapted to releasably secure the fly in a closed position.

8. A garment as in claim 7, wherein the second fastener is chosen from the goup consisting of snaps and buttons.

9. A garment as in claim 6, wherein one edge of each of the first and second flaps extends from the waistband to the base point.

10. A garment as in claim 9, wherein a flow passage is defined between the first and second flaps from an upper end of the shield to a lower end of the shield.

11. A garment as in claim 10, wherein the lower edge of the first flap and the lower edge of the second flap are not attached to one another between the base point and the distal edges of the flaps.

12. A garment as in claim 11, wherein the lower edge of the first flap and the lower edge of the second flap do not substantially overlap each other when the shield is in the closed position.

13. A garment as in claim 10 additionally comprising a secondary base point between the waistband and the base point, wherein the first and second panels are joined at the secondary base point.

14. A garment as in claim 6, wherein the fly has no fastener between the waistband and the base point.

15. A garment closure system, comprising:

first and second panels of a garment;

a fly defined between the first and second panels, the fly having a base point and being adapted to open and close;

shielding means positioned in the fly for preventing visual access through the fly; and means for facilitating substantially unrestricted water flow through the shielding means in a direction substantially parrallel to the fly when the garment is worn in water.

16. A garment as in claim 15 additionally comprising a waistband and means for releasably securing the waistband in a closed position.

17. A garment as in claim 15, wherein the shielding means comprises a first flap and a second flap joined to each other along a seam, the first flap extending from the first panel and the second flap extending from the second panel.

18. A garment as in claim 17, wherein the first flap and the second flap each have a bottom edge, and the bottom edges define a passage through the flaps between the base point and the seam.

19. A garment as in claim 18 additionally comprising a snap positioned in the fly between the waistband and the base point.

20. A garment as in claim 18, wherein the seam is substantially parallel to the fly.

21. A garment comprising:

a first panel having a first edge;

a second panel having a second edge, a portion of the first and second edges being joined to each other along a panel seam;

a panel fly defined between a portion of the first and second edges, the edges being movable into and out of engagement with each other in the panel fly to define an openable garment fly;

a base point located at a junction of the panel seam and the panel fly;

a first flap extending from the first panel and having a first face;

a second flap extending from the second panel and having a second face, the first and second flaps meeting at a fold line and adapted to substantially overlap one another when the fly is in a closed position so that the first face is adjacent the second face; and a flow passage defined between the first and second faces in a direction generally parallel to the fold line.

22. A garment as in claim 21, wherein the first flap and the first panel are formed of a single piece of material.

23. A garment as in claim 21, wherein the first flap has a bottom edge and the second flap has a bottom edge, and the flap bottom edges are not attached to each other between the base point and the fold line.

24. A garment as in claim 23, wherein the flap bottom edges do not substantially overlap each other.

25. A garment as in claim 24, wherein the first flap bottom edge is secured to the panel seam at a first stitch location and the second flap bottom edge is secured to the panel seam at a second stitch location, and the first and second stitch locations do not overlap each other.

26. A garment as in claim 21, wherein the first flap and the second flap are formed of a single piece of material.

27. A garment as in claim 21, wherein the fold line comprises a stitched seam.

28. A fly closure for a garment, the garment including a first panel and a second panel of material, the fly closure having a top end and a bottom end and comprising a first flap extending from the first panel and a second flap extending from the second panel, the first and second flaps cooperating with one another to form a shield, the shield being movable between a first position in which the first and second panels are in close proximity to one another and a second position in which the first and second panels are located a distance away from one another, the flaps substantially overlapping each other when the panels are in the first position, and a fluid flow passage is defined between the flaps in a generally top to bottom direction.

29. A fly closure as in claim 28, wherein the first and second flaps lay flat against one another when the shield is in the first position.

30. A fly closure as in claim 29, wherein the first and second flaps are sewn together along a seam.

31. A fly closure as in claim 28, wherein the shield includes an opening therethrough, the opening defined by an edge of the first flap and an edge of the second flap.

32. A garment comprising:

a first panel;

a second panel adjacent the first panel;

a first flap extending from the first panel in a first direction and having a bottom edge; and a second flap extending from the second panel in the first direction and having a bottom edge, the second flap connected to the first flap along a fold line, the first and second flaps overlapping each other so that a flow channel is defined therebetween, and a portion of the bottom edge of the first flap and a portion of the bottom edge of the second flap do not overlap each other.

33. The garment of claim 32, wherein the first flap and the second flap are formed of a single piece of material.

34. The garment of claim 32, wherein the fold line comprises a flap seam.

35. The garment of claim 32, wherein a garment fly is defined between the first and second panel, and the flaps are positioned adjacent the garment fly.

36. A gannent comprising:

a first panel;

a second panel adjacent the first panel;

a first flap extending from the first panel in a first direction and having top, bottom, and distal edges; and a second flap extending from the second panel in the first direction and having top, bottom, and distal edges;

wherein the first and second flaps are connected along their distal edges, the first and second flaps at least partially overlapping each other, and the top, bottom and distal edges of the first and second flaps are not attached to either of the first and second panels.

37. The garment of claim 36, wherein the first flap and the first panel are formed of a single piece of material.

38. The garment of claim 36, wherein the second flap and the second panel are formed of a single piece of material.

39. The garment of claim 36, wherein the first flap and second flap are not attached to each other along their bottom edges.

40. The garment of claim 36, wherein a flow passage is defined between the first and second flaps, the flow passage being substantially parallel to the flap distal edges.

* * * * *

UNITED STATES PATENT AND TRADEMARK OFFICE

CERTIFICATE OF CORRECTION

PATENT NO. : 6,199,215 B1
DATED : March 13, 2001
INVENTOR(S) : Biggerstaff

It is certified that error appears in the above-identified patent and that said Letters Patent is hereby corrected as shown below:

Column 9,
Line 45, change "parrallel" to -- parallel --.

Column 11,
Line 6, change "A gannent" to -- A garment --.

Signed and Sealed this

Twelfth Day of March, 2002

*Attest:*

*Attesting Officer*

JAMES E. ROGAN
*Director of the United States Patent and Trademark Office*